US007507368B2

(12) United States Patent
Kurita et al.

(10) Patent No.: US 7,507,368 B2
(45) Date of Patent: Mar. 24, 2009

(54) HOT AIR CIRCULATION FURNACE

(75) Inventors: Kiyobumi Kurita, Kanagawa (JP); Noboru Sasaki, Aichi (JP); Yukiharu Itakura, Aichi (JP)

(73) Assignees: Nippon Furnace Kogyo Kaisha, Ltd., Kanagawa (JP); Toyota Jidosha Kabushiki Kaisha, Aichi (JP)

( * ) Notice: Subject to any disclaimer, the term of this patent is extended or adjusted under 35 U.S.C. 154(b) by 333 days.

(21) Appl. No.: 10/579,599

(22) PCT Filed: Aug. 25, 2004

(86) PCT No.: PCT/JP2004/012169

§ 371 (c)(1),
(2), (4) Date: May 17, 2006

(87) PCT Pub. No.: WO2006/021994

PCT Pub. Date: Mar. 2, 2006

(65) Prior Publication Data

US 2007/0107714 A1 May 17, 2007

(51) Int. Cl.
*F24H 3/06* (2006.01)

(52) U.S. Cl. ..... 266/252; 266/262; 432/124

(58) Field of Classification Search ..... 266/249, 266/252, 256, 262; 432/124, 131, 138
See application file for complete search history.

(56) References Cited

U.S. PATENT DOCUMENTS

| | | | | |
|---|---|---|---|---|
| 2,543,710 | A * | 2/1951 | Schmidt et al. | 266/256 |
| 2007/0107714 | A1 * | 5/2007 | Kurita et al. | 126/110 R |

FOREIGN PATENT DOCUMENTS

| | | |
|---|---|---|
| JP | 58-121363 | 8/1983 |
| JP | 58-133316 | 9/1983 |
| JP | 59-038322 | 3/1984 |
| JP | 39-2660 | 2/1986 |
| JP | 09-042834 | 2/1997 |
| JP | 11-201660 | 7/1999 |
| JP | 2000-349103 | 12/2000 |
| JP | 2002-173708 | 6/2002 |

* cited by examiner

*Primary Examiner*—Scott Kastler
(74) *Attorney, Agent, or Firm*—Notaro & Michalos P.C.

(57) ABSTRACT

A small hot-air circulation furnace performs continuous treatment using hot air at a fixed temperature. Hot air supplied from a heat source is blown out from an axial-flow fan toward a hearth to form a circulating flow passing through an annular heating-target mount on the rotating hearth. The heating-targets are taken out one by one after increasing the temperature of the heating-target on the mount to a predetermined point during one rotation of the hearth. Further, a partition whose outlet-side opening $\theta_2$ is narrower than the inlet-side opening $\theta_1$ is provided inside the annular partition to supply part of high-temperature gas blown.

10 Claims, 9 Drawing Sheets

[Fig. 1]
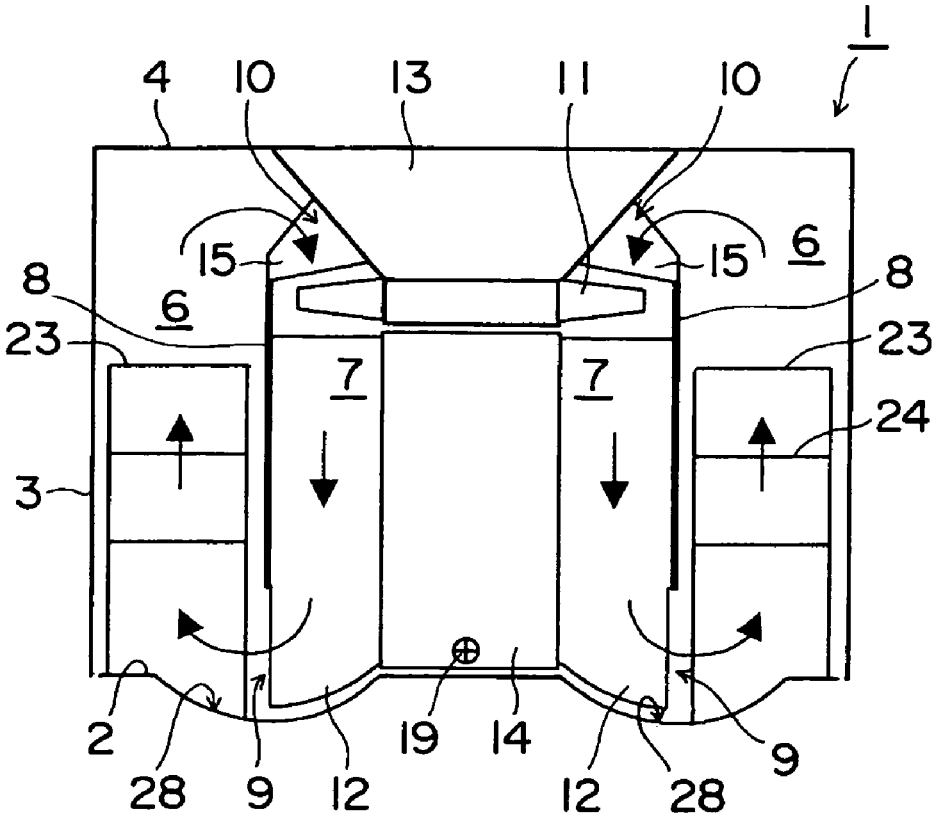

[Fig. 2]
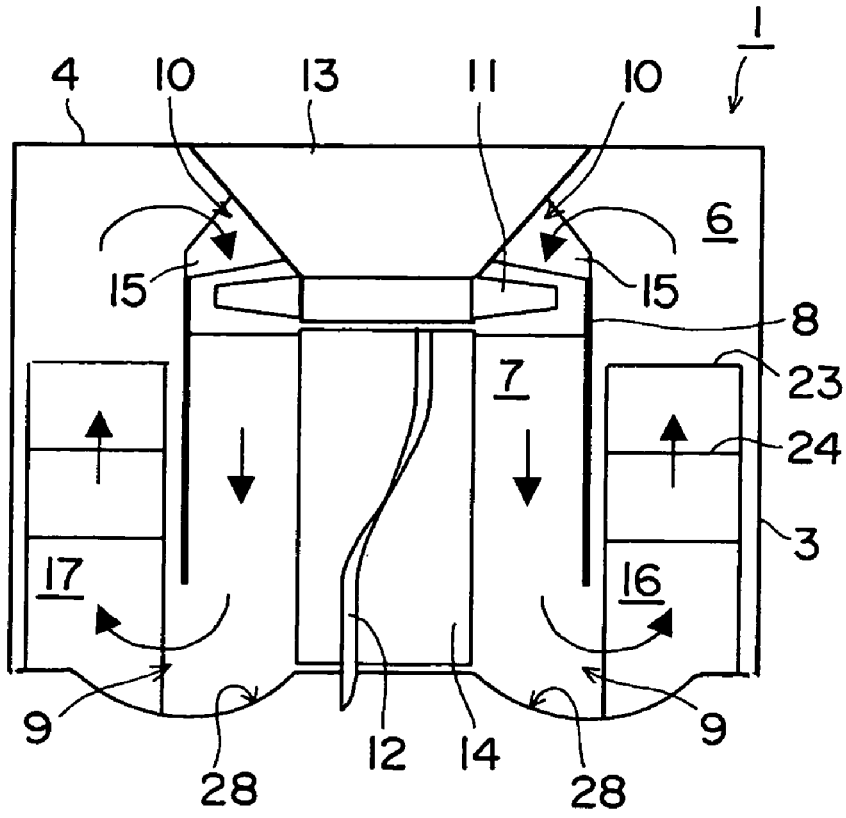

[Fig. 3]
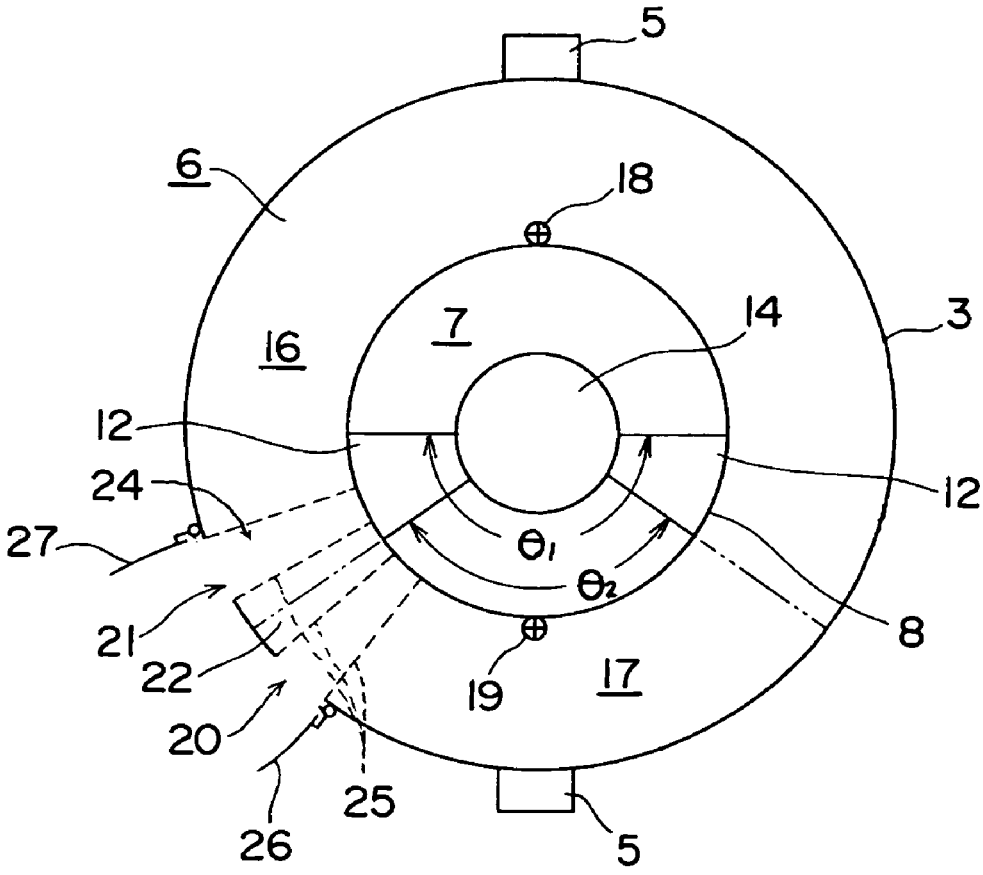

[Fig. 4]
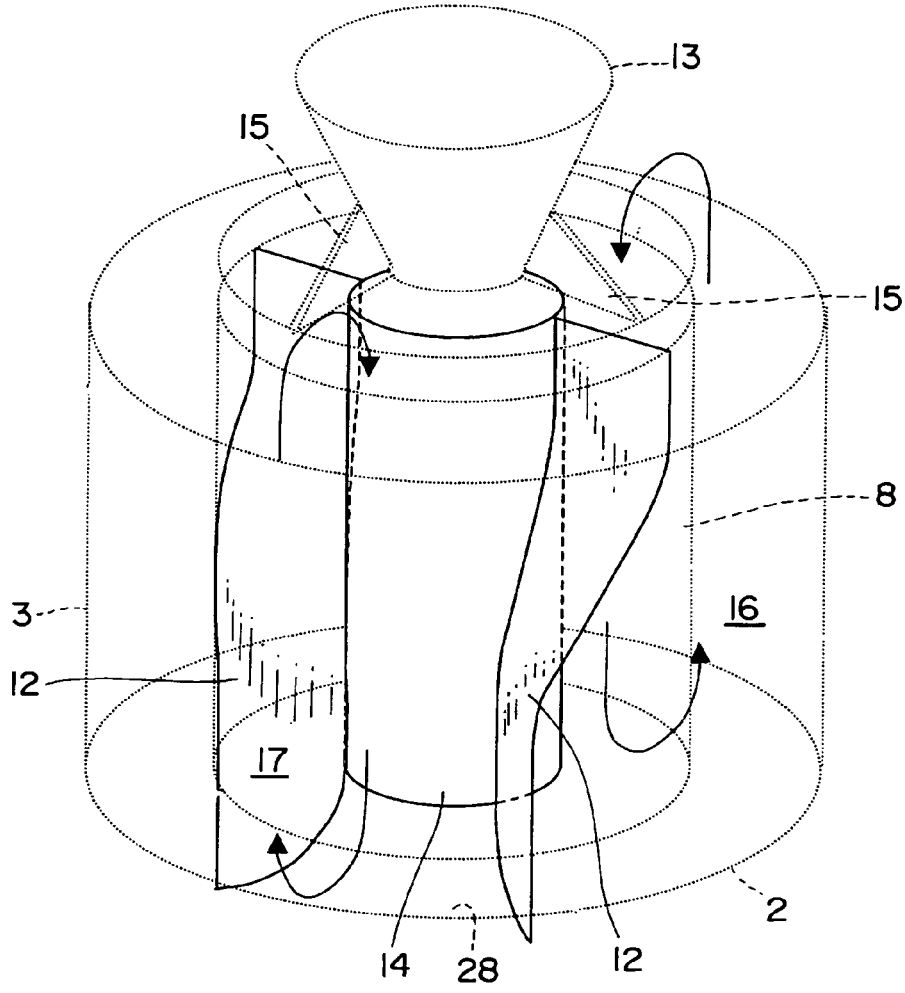

[Fig. 5]
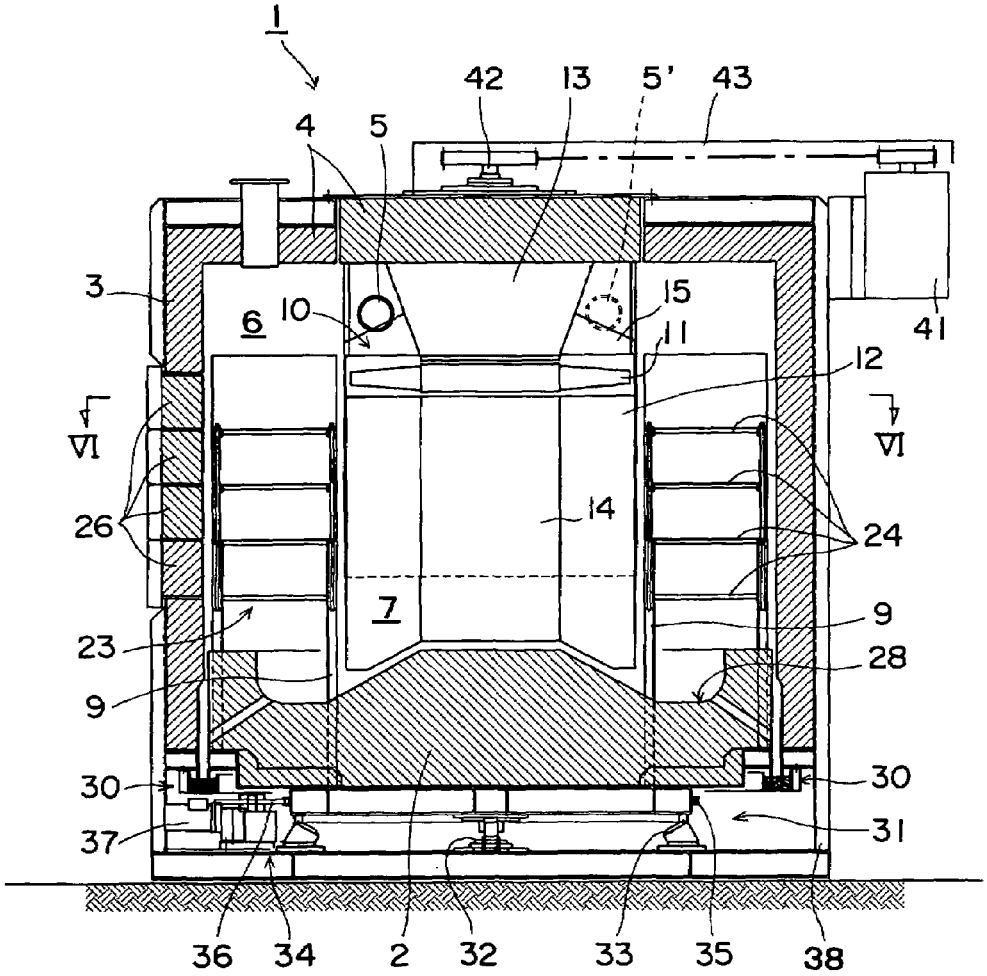

[Fig. 6]
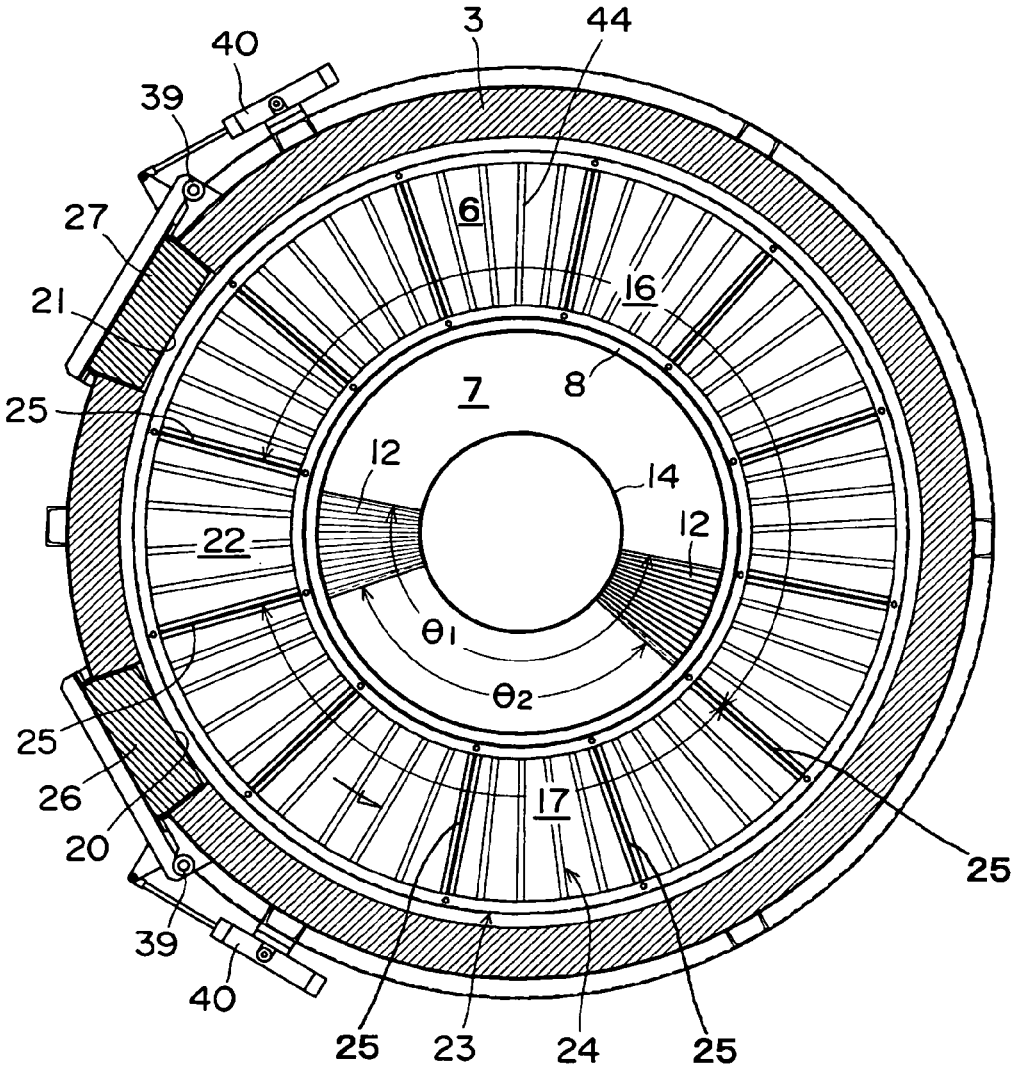

[Fig. 7]
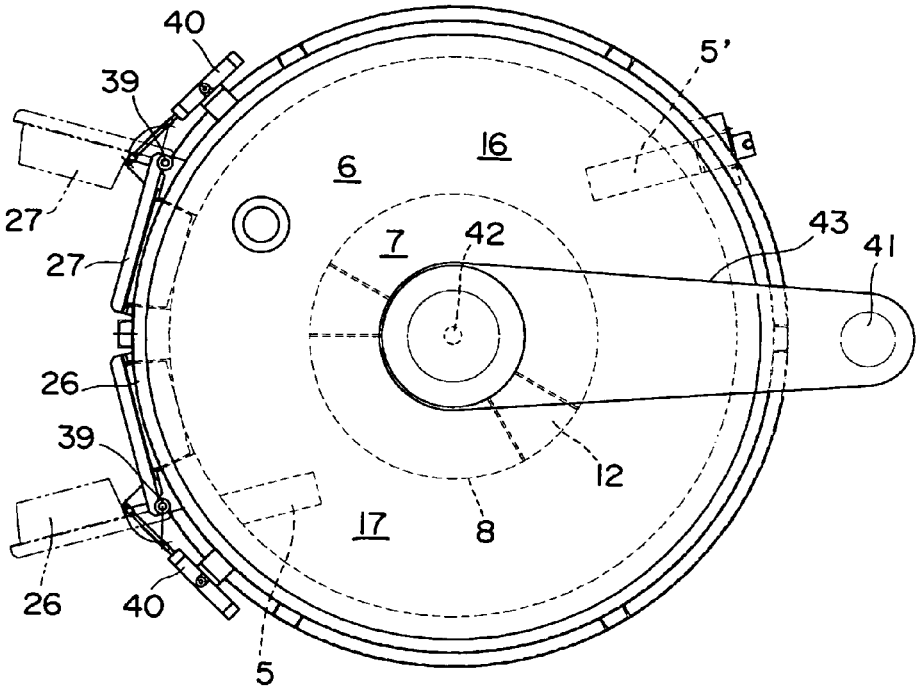

[Fig. 8]
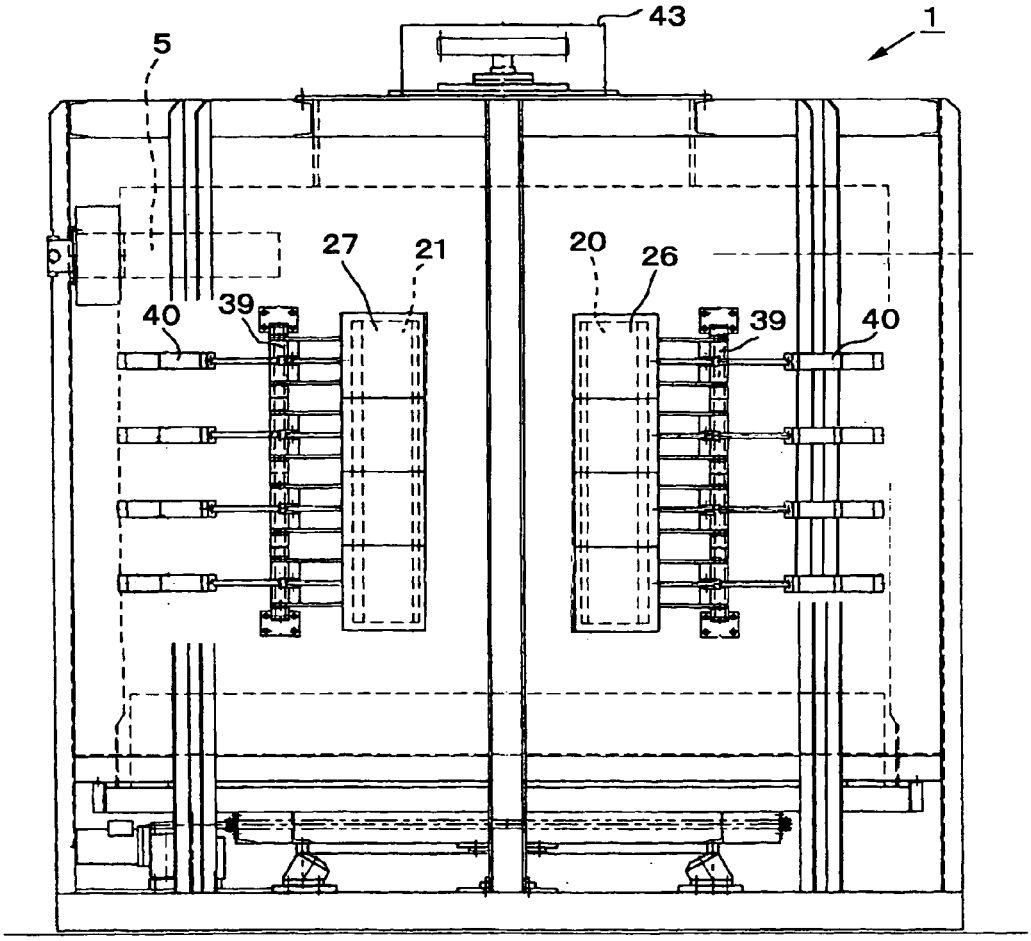

[Fig. 9] PRIOR ART
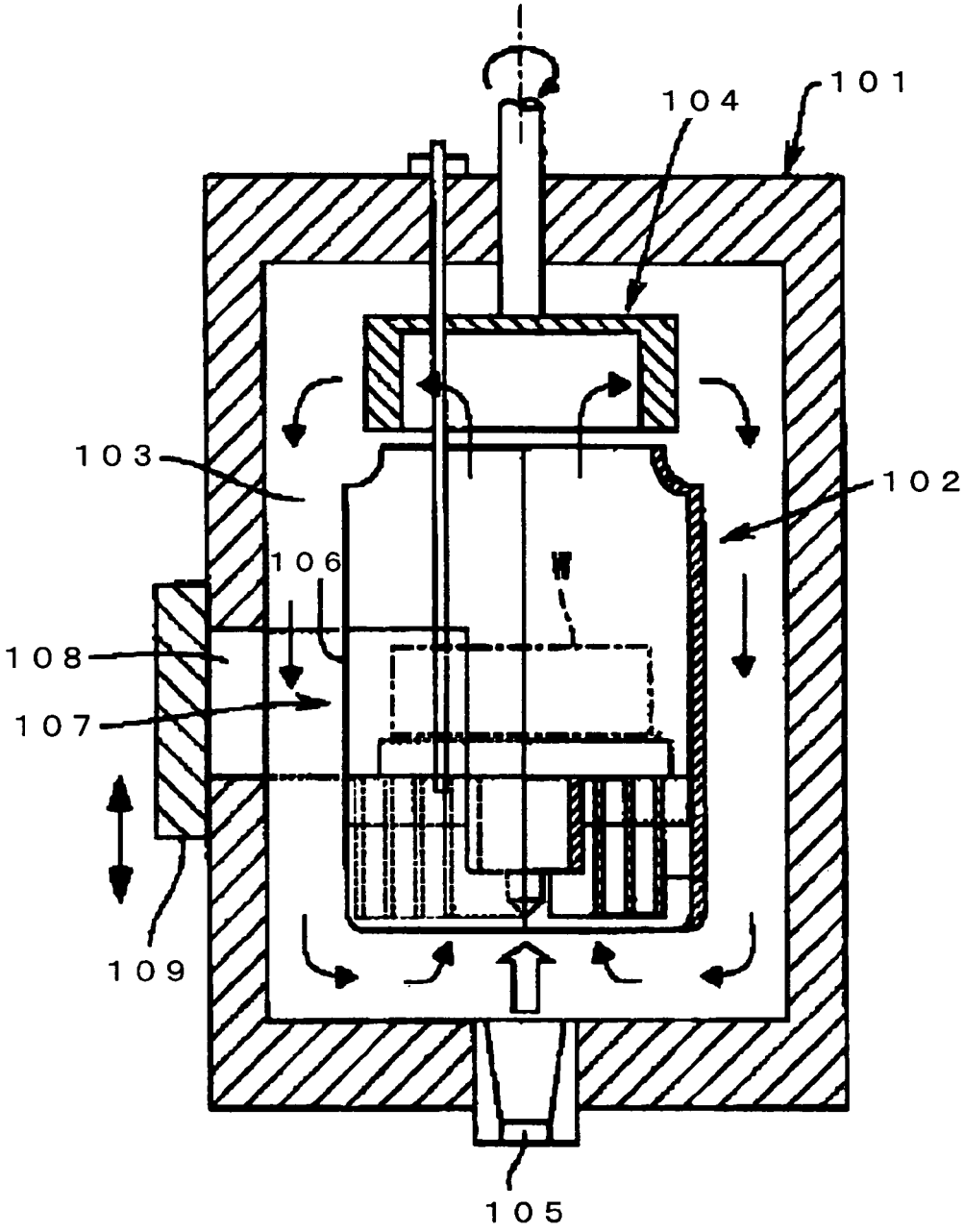

HOT AIR CIRCULATION FURNACE

TECHNICAL FIELD

The present invention relates to a hot-air circulation furnace for heating a material to be heated to a predetermined temperature or for performing a certain heat treatment by hot air circulating in the furnace. More particularly, the present invention relates to a hot-air circulation furnace suitable for heating of a material, such as T6 heat treatment on an aluminum alloy, in which it is comparatively difficult to set the desired thermal head (a temperature difference between a material to be heated and an atmosphere surrounding the material).

BACKGROUND ART

Conventional hot-air circulation-type heating furnaces include, for example, one such as shown in FIG. 9 (Japanese Patent Laid-Open No. 2002-173708). This heating furnace has a furnace body 101 made of fire-resistive material and a heating-target-accommodating casing 102 in the form of a cylinder opened at its upper and lower ends and arranged coaxially with the furnace body 101. In this heating furnace, hot air generated by a burner 105 provided on a furnace bottom portion is forcibly circulated as a spiral flow by convection caused by a circulating fan (sirocco fan) 104 provided above the heating-target-accommodating casing 102 to increase, at a high rate, the temperature of a material W to be heated. The heating furnace is arranged so as to form a circulating flow of the hot air such that the hot air is drawn into the heating-target-accommodating casing 102 through the bottom of the heating-target-accommodating casing 102 by the rotation of the circulating fan 104, passes through the heating-target-accommodating casing 102, and is blown out of the circulating fan 104 into a circulation path 103 between the heating-target-accommodating casing 102 and the furnace body 101 surrounding the heating-target-accommodating casing 102 to flow downward. A door 107 is provided at a second heating-target-transport opening 106 of the heating-target-accommodating casing 102. The circulation path for uniform circulation of the hot air through the entire circumferential region between the furnace body 101 and the heating-target-accommodating casing 102 is maintained by closing the door 107. The material W to be heated is moved into or out of the furnace by opening a door 109 at a first heating-target-transport opening 108 and the door 107 at the heating-target-accommodating casing 102 in the furnace body 101, and heat treatment is performed as a batch treatment.

As an ordinary continuous-type furnace, a long tunnel-type furnace not shown in the drawings exists in which a material to be heated carried into the furnace through a heating-target-carry-in opening at one end is heated to a predetermined temperature while being moved toward a heating-target-carry-out opening at the other end.

Since batch type treatment is carried out in the heating furnace shown in FIG. 9, there is a problem described below. Each time a material to be heated is carried into or out of the furnace, a large amount of in-furnace hot air flows out of the furnace and cold air outside the furnace flows into the furnace. The interior of the furnace is thereby cooled. Therefore, the thermal efficiency is low and the treatment time is long.

Also, since the circulating fan 104 used in this furnace is a sirocco fan constructed so that blades are exposed, there is a problem that in actuality the desired circulating flow is not generated and high-rate heating cannot be achieved. The amount of air caused by a sirocco fan to flow is determined by the design of a casing surrounding the sirocco fan. If the blades of a sirocco fan are exposed without being covered with a casing, the desired amount of flowing air cannot be obtained. Therefore, if only a sirocco fan having its blades exposed is provided, it is incapable of static-pressure recovery and only agitates air around the fan, resulting in a failure to generate a flow circulating through the entire furnace.

Even if a casing is provided to obtain the desired amount of flowing air, the circulating flow is generated as a spiral and is, therefore, formed in a one-sided condition and hot air cannot be brought into uniform contact with the material to be heated. Thus, there is a problem that heating unevenness occurs easily.

Moreover, in the case of heating by hot air circulating while forming a spiral, the interior of the furnace cannot be divided into a heating zone and a soaking zone. For this reason, it takes time to increase the temperature of the material to be heated to a predetermined point. The influence of this is considerable particularly in the case of heating of a material to be heated such as aluminum with which it is difficult to set a large thermal head. For example, annealing (solution annealing) of an aluminum alloy is performed at a temperature close to the melting point (softening point) of the aluminum and it is, therefore, impossible to reduce the temperature rise time (time required for reaching the solution annealing temperature) by setting a large thermal head because of the risk of solution damage to or deformation of the material to be heated. Thus, increasing the temperature of a material to be heated necessarily depends on heating by convection heat transfer in the case of a furnace in which heating by radiation heat transfer is limited due to the existence of a limit furnace temperature. In ordinary cases of T6 treatment in a medium temperature range of about 500° C., the thermal head is small and, therefore, the proportion of the amount of heating by convection heat transfer is increased while the proportion of the amount of heating by radiation heat transfer is reduced. The amount of heat transfer by convection heat transfer in the case of using a basket is about 85% and the amount of heat transfer by radiation heat transfer is about 15%. Since the heating power by convection heat transfer is determined by a function of the flow rate and the flow velocity of the heated fluid, it is very important to suitably design the circulating fan. In actual designing of the furnace, however, the flow rate or the flow velocity of the circulating fan cannot be increased without limitation and there is a limit to the increase in size of the fan to be installed in relation to the size of the furnace body. That is, it is difficult to improve the heating power by convection heat transfer if the furnace body is small.

Further, since a material to be heated is placed at a center of the furnace body 2 and since the circulating path is provided therearound, there is a problem that the amount of dead space is large; the treatable amount of material to be heated is reduced with respect to the furnace capacity; and the heating efficiency is low.

In the case of the tunnel-type continuous treatment furnace, there is a problem that the size of the furnace body is increased. In particular, in the case of heating of a material to be heated such as aluminum with which it is comparatively difficult to set the desired thermal head, the required heating time is long and there is a tendency toward a further increase in the length of the furnace.

On the other hand, the form of production has changed continuously and diversified and demands for various heating facilities and heat treatment facilities other than the existing demand for reducing the production cost by using a large continuous furnace have arisen in relation to the materials and forms of products, the amounts of production and so on. For example, it is desirable that a heat treatment furnace of a small amount of processing should be placed at an end of a casting line to enable a produced casting to be directly heat treated in the final step of the casting line, whereby the need for the wasteful method of temporarily cooling a casting and thereafter heating the casting from ordinary temperature is eliminated. Also, in production of an aluminum casting, there is a need to heat the materials one by one to perform primary heating, secondary heating, solution annealing and age-hardening. In such a case, it is desirable to provide a heat treatment furnace of a small amount of processing capable of carrying in, transporting and carrying out pieces of material to be heated one by one. The same can be said with respect to nonferrous metal alloys and steel as well as aluminum products. Such a demand cannot be easily met by using a conventional large tunnel-type continuous furnace presupposing large-amount treatment.

It is, therefore, an object of the present invention to provide a continuous-type hot-air circulation furnace small in size but having a large throughput. Another object of the present invention is to provide a hot-air circulation furnace capable of uniformly heating a material to be heated. Still another object of the present invention is to provide a hot-air circulation furnace capable of forming a heating zone and a soaking zone.

DISCLOSURE OF THE INVENTION

To achieve the above-described object, according to the present invention, there is provided a hot-air circulation furnace comprising: a furnace body having a heat source and a rotating hearth; a heating-target mount having a heating-target mount shelf, which is provided at a position on the rotating hearth closer to the outer periphery of the rotating hearth along a peripheral wall of the furnace body, on which a heating-target is mounted so that the heating-target can be carried in or carried out in a radial direction, and through which a circulating flow can pass along a vertical direction; an axial-flow fan, which is provided in the vicinity of a roof of the furnace body, and which draws in hot gas in a direction from its outer periphery toward its central portion and blows out the hot gas toward the rotating hearth; and an annular partition, which separates the interior of the furnace into an outer peripheral region in which the heating-target mount is installed and an inner region inside the outer peripheral region, and which defines paths in which the circulating flow is reversed in the vicinity of the rotating hearth of the furnace body and in the vicinity of the roof of the furnace body.

Accordingly, the hot air supplied from the heat source forms circulating flows blown out by the axial-flow fan into the space in the inner region inside the annular partition, moving downward toward the hearth along the annular partition, flowing out of the annular partition via the path in the vicinity of the rotating hearth, moving upward while passing through the heating-target mount shelf of the heating-target mount, again heated by the heat source or mixed with hot air supplied from the heat source so that the temperature of the hot air is increased to a predetermined point, and thereafter drawn into the axial-flow fan, i.e., flows circulating between the inner region inside the annular partition and the outer peripheral region outside the annular partition through the entire interior of the furnace. The axial-flow fan has such characteristics as to draw in the atmospheric gas on the outer peripheral side without strongly agitating the gas and to blow out the gas in the axial direction (the direction toward the furnace bottom) and can therefore form circulating flows passing through generally fixed positions in the inner region and the outer peripheral region, thereby enabling the output (heat) of a particular heat source to be supplied to a particular zone.

Moreover, in the hot-air circulation furnace of the present invention, preferably, a plurality of zones are formed in the furnace body and a heat source which is independently controllable is provided in correspondence with each zone. For example, a plurality of zones such as a heating zone and a soaking zone are provided and heat sources, e.g., burners are provided in correspondence with the zones. The outputs (amounts of combustion) can be separately controlled according to the temperatures in the zones, thereby making it possible to separately supply amounts of heat required with respect to the zones, e.g., the necessary amount of heat for the heating zone where the temperature drop caused by the heating-target newly thrown in is large and the necessary amount of heat for the soaking zone where the temperature drop is small. Thus, amounts of heat can be supplied such that the temperature of the hot gas supplied to the heating zone and the temperature of the hot gas supplied to the soaking zone are equalized or a desired temperature difference is set.

The formation of zones is achieved by forming circulating flows extending through substantially fixed positions. However, it can be achieved more easily and more reliably by placing a flow straightening member in a portion of circulating flow path, particularly in the vicinity of the axial-flow fan, e.g., in the vicinity of one of the drawing-in side or the blowing-out side of the axial-flow fan or both in vicinity of the drawing-in side and in the vicinity of the blowing-out side of the axial-flow fan. For example, the flow straightening effect is further improved by providing a flow straightening member along the circulating flow in the inner region inside the annular partition or in a space on the upstream side of the axial-flow fan, i.e., the outer peripheral region outside the annular partition. Therefore, the in-furnace atmospheric gas can circulate through generally fixed positions and a plurality of zones can be easily formed. A flow straightening member having a surface parallel to the flowing direction of the circulating flow may suffice. A partition for region portioning or a guide may function as a suitable flow straightening member.

Preferably, in the hot-air circulation furnace in accordance with the present invention, a partition is provided inside the annular partition for supplying the hot gas blown out from the axial-flow fan to the heating-target mount while increasing the velocity of part of the hot gas by reducing the opening of the space in the inner region at the outlet side relative to the opening of the space at the inlet side. In this case, the hot air blown out from the axial-flow fan is uniform in flow rate. The hot air is introduced at a rate according to the opening area at the inlet side of the partition and is blown out through the outlet-side opening, the opening area of which is smaller than the inlet-side opening area. Therefore, the hot air is blown out below the heating-target mount at a velocity increased according to the amount of reduction in the outlet-side opening area, and moves upward by passing through the heating-target mount shelf. That is, part of the hot air can form a partial region in which the velocity of the circulating flow is increased relative to that in the other region.

EFFECT OF THE INVENTION

As is apparent from the above description, the axial-flow fan can be installed by utilizing a dead space at a center of the hot-air circulation furnace of the present invention. Thus, the space in the furnace can be effectively utilized and the furnace can be made compact by eliminating an unnecessary space. Moreover, since the annular heating-target mount is placed at the outer periphery of the rotating hearth, the heating-target mount shelf of the maximum length can be constructed to enable treatment on a large amount of heating-target for the installation area of the furnace.

In the hot-air circulation furnace of the present invention, in-furnace circulation of hot gas is caused by the axial-flow fan such that the gas is made to circulate generally fixed positions without largely agitating the atmosphere at the outer periphery of the fan and the circulation is therefore uniform in flow rate, thus achieving uniform heating. Moreover, since the hot-air circulation furnace of the present invention is a continuous furnace in which heating-targets are taken out one by one after increasing the temperature of the heating-target to be a predetermined point during one revolution of the heating-target mount, the thermal efficiency of the furnace is high and the treatment time is short.

Further, the output of a particular burner can be supplied to a particular zone. Therefore, a necessary amount of heat can be applied to a necessary place to form a desired in-furnace temperature distribution.

According to the present invention, a plurality of zones can be formed in the furnace and independently controllable heat sources can be provided in correspondence with the zones. For example, a plurality of zones such as a heating zone, a soaking zone may be provided; heat sources, e.g., burners may be provided in correspondence with the zones; and the outputs (amounts of combustion) of the heat sources may be independently controlled according to the temperatures of the zones, thereby making it possible to separately supply amounts of heat required with respect to the zones, e.g., the necessary amount of heat for the heating zone where the temperature drop caused by the heating-target newly thrown in is large and the necessary amount of heat for the soaking zone where the temperature drop is small. That is, amounts of heat can be supplied such that the temperature of the hot gas supplied to the heating zone and the temperature of the hot gas supplied to the soaking zone are equalized or a desired temperature difference is set. Therefore, the time required for increasing the temperature of the heating-target to a predetermined point can be effectively reduced, while the size of the furnace is small. Also, a heating pattern and a kind of heat treatment freely selected can be realized by performing temperature control on a zone-by-zone basis.

In the rotating-hearth-type hot-air circulation furnace in accordance with the present invention, a partial region can be formed in which the velocity of a circulating flow is increased relative to that in other regions. Accordingly, in heating based mainly on convection heat transfer, a heating zone and a soaking zone can be formed while using a circulating gas operating at a fixed temperature. The heating zone and the soaking zone can be set without providing a large thermal head. Therefore, the present invention enables, in particular, heating or heat treatment on a heating-target such as an aluminum alloy with which it is difficult to set a large thermal head, and is suitable for T6 heat treatment on an aluminum alloy for example.

BRIEF DESCRIPTION OF THE DRAWINGS

FIG. 1 is a front view of a hot-air circulation furnace of the present invention, showing the principle of the invention;

FIG. 2 is a side view of the hot-air circulation furnace;

FIG. 3 is a plan view of the hot-air circulation furnace;

FIG. 4 is a perspective view of the hot-air circulation furnace;

FIG. 5 is a central longitudinal sectional view of an embodiment of application of the hot-air circulation furnace of the present invention to an aluminum T6 heat treatment furnace;

FIG. 6 is a cross-sectional view of the T6 heat treatment furnace;

FIG. 7 is a plan view of the T6 heat treatment furnace;

FIG. 8 is a front view of the T6 heat treatment furnace; and

FIG. 9 is a front view of a conventional heat treatment furnace.

DESCRIPTION OF SYMBOLS

1 Furnace body
2 Hearth
3 Peripheral wall
4 Roof
5, 5' Heat source
6 Outer peripheral region
7 Inner region
8 Annular partition
9 Lower path
10 Upper path
11 Axial-flow fan
12 Partition for zone separation
16 Soaking zone
17 Heating zone
20 Charging opening
21 Extraction opening
22 Heating-target accommodation space
23 Heating-target mount
24 Heating-target mount shelf
25 Partition

BEST MODE FOR CARRYING OUT THE INVENTION

The present invention will be described in detail with respect to a mode of implementation thereof with reference to the drawings.

FIGS. 1 to 4 are diagrams schematically showing the principle of implementation of a hot-air circulation furnace of the present invention. This hot-air circulation furnace is a continuous furnace in which a hearth 2 portion of a furnace body 1 is formed of a turn table; pieces of material to be heated (not shown) (referred to as "heating-target" in this specification) are placed on a heating-target mount 23 installed on the hearth 2; predetermined heating is completed during one rotation of the hearth 2; and the heating-targets can be taken out one after another at a revolution completion point.

The furnace body 1 is formed of members made of a fire/heat-resistant material or the like: a cylindrical peripheral wall (side wall) 3, a roof 4, and the hearth 2 separate from the peripheral wall 3 and the roof 4 and rotatable. Heat sources 5 are provided outside the peripheral wall 3. The peripheral wall 3 surrounding the rotating hearth 2 and the roof 4 are mounted and fixed on a furnace supporting structure not shown in the figure.

The interior of the furnace is partitioned into an outer peripheral region 6 where the heating-target mount 23 are installed and an inner region 7 provided inside the outer peripheral region 6, the regions 6 and 7 being separated by an annular partition 8. The annular partition 8 is provided so as to form upper and lower paths 9 and 10 in the vicinity of the rotating hearth 2 and in the vicinity of the roof 4, respectively, at which a circulating flow is reversed, instead of completely partitioning the entire region between the hearth 2 and the roof 4. That is, the sections of the furnace separated as the inner region 7 and the outer peripheral region 6 by the annular partition 8 communicate with each other through the lower path (opening) 9 in the vicinity of the hearth 2 and the upper path (opening) 10 in the vicinity of the roof 4, thereby enabling a gas to circulate between the outer peripheral region 6 and the inner region 7 when caused to flow by driving an axial-flow fan 11.

The axial-flow fan 11 is provided at a center of the furnace body in the vicinity of the roof 4 while being directed toward the hearth 2. The axial-flow fan 11 draws in a hot gas in a direction from the outer periphery of the fan toward a center and blows out the gas toward the hearth 2, thereby forming circulating flows flowing radially from the center of the furnace body through inner region 7→lower path 9→outer peripheral region 6→upper path 10→inner region 7 in the entire interior of the furnace. The axial-flow fan 11 has such characteristics as to draw in the atmospheric gas on the outer peripheral side without strongly agitating the gas and to blow out the gas in the axial direction (the direction toward the bottom of the furnace) and can therefore form circulating flows passing through generally fixed positions in the inner region 7 and the outer peripheral region 6. The circulating flows extend through certain routes and heat supplied through the routes is applied to certain places. That is, the circulating flows form zones.

The formation of zones is achieved by forming circulating flows extending through substantially fixed positions. In addition, a suitable partition or a guide may be placed in a portion of each circulating flow path, particularly in the vicinity of the axial-flow fan, e.g., in the vicinity of one of the drawing-in side or the blowing-out side of the axial-flow fan or both in the vicinity of the drawing-in side and in the vicinity of the blowing-out side of the axial-flow fan to further improve the flow straightening effect and to enable zones to be formed more easily and reliably. For example, a partition extending along the circulating flow may be provided in the inner region inside the annular partition or a partition may be provided in a space located upstream of the axial-flow fan, i.e., in the outer peripheral region outside the annular partition, to further improve the flow straightening effect and to thereby enable the atmospheric gas in the furnace to circulate through generally fixed positions, thus enabling a plurality of zones to be easily formed. Thus, even though only one axial-flow fan is provided, zones can be easily separated if a partition or a guide is provided.

Therefore a partition may be provided in the inner region 7 inside the annular partition 8 as a flow straightening member for reliably separating zones as required. In this embodiment, partitions 12 which narrow an opening on the outlet side relative to an opening on the inlet side through which the circulating flow flows in are mounted to the roof 4 by means of a cover 13 for the axial-flow fan 11. In this case, the angle $\theta_2$ of the outlet opening of the inner region 7 defined by the partitions 12 in the vicinity of the hearth 2 is reduced relative to the angle $\theta_1$ of the inlet opening of the inner region 7 in the vicinity of the roof to increase the circulating gas flow velocity by the reduction in the opening area, thus enabling part of the high-temperature gas blown out from the axial-flow fan 11 to be supplied to the heating-target mount 23 while increasing the flow velocity thereof. If there is no need to change the flow velocity (heated condition) of the circulating flow in an internal portion of the furnace, and if there is only a need for more definite zone separation, partitions for straight partitioning (not shown) such that the inlet opening angle $\theta_1$ and the outlet opening angle $\theta_2$ are equal to each other are used.

A cylindrical member 14 for closing a dead space at a center of the furnace is placed at the dead space to prevent the flow from being disturbed.

The annular partition 8 in this mode of implementation is suspended from the roof 4 by utilizing the cover 13 for the axial-flow fan 11 mounted to the roof 4. That is, the annular partition 8 is suspended, for example, by means of three stays 15 in the form of plates from the cover 13 in the form of an inverted cone covering a bearing portion of the roof 4 on which the rotating shaft of the axial-flow fan 11 is supported. Further, the radial partitions 12 placed along a diametric direction are mounted inside the annular partition 8, and the cylindrical member 14 for closing the dead space at the center of the furnace is suspended from the roof 4 by being attached to the partitions 12 inside the partitions 12. The annular partition 8, the partitions 12 and the cylindrical member 14 are connected to each other by welding or riveting and integrally mounted to the furnace body 1 by means of the cover 13 attached to the roof 4. The cylindrical member 14 and the annular partition 8 are placed coaxially with the rotational center of the hearth 2. Therefore, it is not necessarily required that the cylindrical member 14 and the annular partition 8 be supported by being mounted to a stationary member on the furnace body side, e.g., the roof 4, while it is necessary for the partitions 12 for zone separation to be set in a fixed position independent of the rotation of the hearth 2. That is, in some case, the cylindrical member 14 and the annular partition 8 may be installed so as to stand on the hearth 2. The conical cover 13 and the stays 15 smooth the flow of the in-furnace atmospheric gas introduced into the axial-flow fan 11 without disturbing the same and thereby achieve a flow straightening effect.

In the hearth 2, a reversing portion 28 for smoothly reversing the downward hot air flow so that the downward flow is converted into an upward flow is provided in annular form along the annular partition 8 between the outer peripheral region 6 and the inner region 7. In this mode of implementation, the reversing portion 28 is formed as a recessed portion semicircular in transverse section. The reversing portion 28 of the hearth 2 is formed in a region other than a peripheral portion and a central portion of the hearth 2 by considering installation of the heating-target mount 23 and the flowing position of the circulating flow. The reversing portion 28 is provided so that its outer edge is positioned outside a center of the heating-target mount 23 and its inner edge is positioned in the vicinity of the cylindrical member 14 closing the dead space at the center of the hearth 2, and so that hot air moves upward substantially from the center of the heating-target mount 23. The reversing portion 28 may alternatively be formed by providing a skirt in the cylindrical member 14 as an upwardly bent semicircular portion. In such a case, a recessed portion simpler in shape and uniform in depth may suffice as the portion other than the outer peripheral portion of the hearth 2 in the fire/heat-resistant material constituting the hearth 2. As a result, the facility with which the hearth 2 is manufactured is improved. The skirt portion is formed of the same material as that of the cylindrical member 14, combined integrally with the cylindrical member 14 by welding for example and installed on the hearth 2 together with the cylindrical member 14.

On the rotating hearth 2 in the outer peripheral region 6, the annular heating-target mount 23 is provided along the peripheral wall 3. The heating-target mount 23 is provided with a heating-target mount shelf 24 which is at least a simple shelf with no outer peripheral wall, on which a heating-target is placed so as to be loadable and extractable outwardly in a diametric direction (radial direction), and through which the circulating flow can pass along a vertical direction. Preferably, heating-target mount shelves 24 are provided in a plurality of stages. The number of heating-targets processable at a time is increased in correspondence with the number of shelves to enable high-volume processing. Preferably, partitions 25 for maintaining vertical hot-air flow paths between the plurality of heating-target mounts 23 are provided on the heating-target mount 23. In this mode of implementation, partitions 25 are radially placed on the annular heating-target mount 23 to partition the heating-target mount 23 in the circumferential direction to provide heating-target accommodation spaces 22. Since a small leak of hot air is not a problem with the zone partitions, a simple structure in which thin iron plates are inserted in vertical grooves or slits extending from the hearth 2 toward the roof 4 may suffice. This support permits free expansion of the partitions 25. For example, partitions 25 formed of steel plates are expandably supported by being inserted in steel channels disposed at the inner and outer sides of the heating-target mount 23 and extending vertically or in slits or the like opened in the vertical direction. Needless to say, each of the components disposed in the furnace, including the heating-target mount 23, the annular partition 8, the partitions 12 for zone separation and the cylindrical member 14, is formed of a suitable material, e.g., heat-resisting steel according to the temperature and the composition of the circulating hot gas. The independent heating-target accommodation spaces 22 are formed on the shelves at positions corresponding to each other in the vertical direction to provide vertical communication paths. Hot air moving upward therein can be regulated so as not to flow into any of the adjacent heating-target accommodation spaces 22, thereby maintaining the circulating flows passing through generally fixed positions as a whole even if the circulating flows are disturbed by contact with the heating-target. In this way, zone separation is further facilitated even though only one axial-flow fan is provided.

Each heating-target mount shelf 24 is made of a gas permeable material or has a gas permeable structure to enable hot air to smoothly pass therethrough. Preferably, the shelf is formed, for example, of rods disposed by being spaced apart from each other in a diametric direction or in a circumferential direction or both in the diametric direction and in the circumferential direction, a mesh work, or a punched metal plate. Further, in some case, only frame members forming an outer peripheral portion and an inner peripheral portion of the heating-target mount shelf 24 may be provided to support two ends of each piece of heating-target, i.e., an inner end and an outer end. That is, the heating-target mount shelf 24 may be formed of a double ring structure having an outer peripheral ring and an inner peripheral ring only. If such a heating-target mount shelf capable of supporting heating-targets without any basket is provided, the need for the amount of heat for heating a basket is eliminated and an improvement in fuel consumption rate and a reduction in heating-target temperature rise time can be achieved. Also, the need for the basket manufacturing and maintenance costs is eliminated.

A charging opening 20 and an extraction opening 21 for enabling putting in and taking out of the heating-target are provided in the peripheral wall 3 of the furnace body 1. Preferably, the charging opening 20 and the extraction opening 21 are provided in correspondence with the heating-target mount shelf 24 in each stage of the heating-target mount 23. In this case, it is possible to charge or extract each of heating-targets when necessary by opening only the corresponding heating-target accommodation spaces 22. Thus, the thermal loss caused at the time of charging or extraction of the heating-target is reduced. Further, preferably, the charging opening 20 and the extraction opening 21 are respectively provided with doors 26 and 27 which is independently openable and closable, and a space between the charging opening 20 and the extraction opening 21 is set so as to have at least one heating-target accommodation space 22 of the heating-target mount 23. In this case, direct communication between the charging opening 20 and the extraction opening 21 can be prevented more reliably, and adjacency between the heating-target the temperature of which has been increased as desired and that will be immediately extracted and the low-temperature heating-target that has just been charged can be avoided to limit the reduction in temperature due to the low-temperature heating-target of the heating-target that will be immediately extracted. In some case, however, the charging opening 20 and the extraction opening 21 may be placed adjacent to each other without providing a spacing. In some case, the charging opening 20 and the extraction opening 21 may be combined in one common opening provided in one place. Further, one door containing doors provided in correspondence with the heating-target mount shelves 24 may be provided. Even in a case where the charging opening 20 and the extraction opening 21 are placed adjacent to each other by being spaced apart from each other by a distance smaller than the spacing corresponding to one heating-target accommodation space 22, the charging opening 20 and the extraction opening 21 can be separated from each other to a certain extent if the partition 25 exists between the two openings 20 and A burner is preferably used as the heat source 5. In some case, however, a radiant tube or an electric heater may be used. In a case where a burner is used, the burner is placed outside the peripheral wall of the furnace body and installed so as to jet a combustion gas substantially along a line tangent to the circumference of the axial-flow fan placed at the center of the furnace body. If in this case a circulating flow generated in the furnace is separated into flows in a plurality of zones, it is preferable to provide the burner 5 as a heat source in correspondence with each zone and to enable the outputs of the burners to be controlled independently of each other. In this case, the atmospheric gas in the furnace can circulate by passing certain places and the output of a particular one of the burners can be supplied to a particular one of the zones. A temperature setting can be made with respect to each zone, or a necessary amount of heat can be supplied to each zone to prevent occurrence of a temperature difference between the zones.

In the heating zone 17 and the soaking zone 16, temperature sensors, e.g., thermocouples 18 and 19 are provided to measure the temperature of the circulating gas immediately before the gas is supplied to the heating-target mount 23 in the outer peripheral region 6. The corresponding heat sources 5 are controlled so that the circulating gas temperatures detected with the thermocouples 18 and 19 become equal to set temperatures.

In the hot-air circulation furnace constructed as described above, a heating-target is charged through the charging opening 20 onto the shelf 24 of the heating-target mount 23, is exposed to hot air passing through the heating-target mount shelf 24 and rising while rotating through one revolution in the furnace, has its temperature increased to a predetermined point by exposure to the hot air, and is thereafter taken out through the extraction opening 21 adjacent to the insertion opening 20.

The hot air circulated by the axial-flow fan 11 passes generally fixed positions in the inner region 7 and the outer peripheral region 6 under certain effects including the flow straightening effect of the partitions 12 and heats the heating-target, and the temperature of the hot air is again increased to the predetermined point by heating with the heat source 5 or by mixing with the hot air supplied from the heat source 5. The amount of heat required with respect to each zone can be supplied. For example, flows of hot gas can be supplied to the zones while equalizing the temperatures thereof or setting a predetermined temperature difference therebetween.

At this time, since the partitions 12 are formed for constriction such that the outlet opening angle $\theta_2$ is smaller than the inlet opening angle $\theta_1$, the amount of hot air according to the inlet-side opening area of the partitions 12 in the hot air uniformly blown out from the axial-flow fan 11 is introduced and is blown out from the bottom of the heating-target mount 23 while the velocity of the hot air is increased according to the amount of reduction in the outlet-side opening area. That is, part of the hot air can form a partial region in which the velocity of the circulating flow is increased relative to that in the other region. In the heating temperature region in which convection heat transfer is dominant, therefore, the heating zone 17 and the soaking zone 16 can be formed by virtue of the flow velocity difference even though the circulating gas controlled at the same temperature is used. That is, the heating zone 17 and the soaking zone 16 can be set without providing a large thermal head. Needless to say, it is possible to set a temperature difference between the flows of hot air and to supply the flows of hot air with the set temperature difference. Further, it is possible to supply the flows of hot air while setting a temperature difference and a velocity difference. As a result, the time required to increase the temperature of the heating-target to the predetermined point can be shortened.

EMBODIMENT

FIGS. 5 to 8 show an example of implementation of the hot-air circulation furnace of the present invention as an aluminum T6 heat treatment furnace. This rotating-hearth-type aluminum T6 heat treatment furnace is a continuous furnace in which a hearth 2 is mounted on a turn table 31; a heating-target mount 23 is installed on the hearth 2; T6 heat treatment on a heating-target on the heating-target mount 23 is completed while the hearth is rotated through one revolution by the rotation of the turn table 31; and heating-targets thus heat-treated can be taken out one after another.

A furnace body 1 is formed of members made of a fire/heat resistant material: a cylindrical side wall (peripheral wall) 3, a roof 4, and the rotating hearth 2 separate from the peripheral wall 3 and the roof 4. A gap is formed between an outer rim of the rotating hearth 2 and an inner peripheral surface of the peripheral wall 3 to avoid contact therebetween. A sand seal 30 is provided at the gap.

The hearth 2 has an annular recessed portion formed in concentric-circle form in its surface forming a furnace bottom. A reversing portion 28 for converting hot air blown toward the hearth 2 into an upward flow is thereby formed integrally with the hearth 2. The reversing portion 28 is an annular recessed portion formed in a region of the hearth 2 other than a peripheral region and a central region and having an inside surface sloping comparatively gently and a vertical outside wall surface rising vertically with a slight outward deviation from the position corresponding to a center of the heating-target mount 23. The reversing portion 28 guides, from the sloping surface to the vertical wall surface, hot air flowing downward in the space between a cylindrical member 14 closing a central dead space of the furnace and an annular partition 8 to smoothly reverse the flow of the hot air, thereby converting the flow of hot air into an upward flow flowing-upward from a position substantially right below the heating-target mount 23.

The turn table 31 is supported horizontally rotatably on a supporting structure member 38 by using a thrust bearing 32 and an angular radial bearing 33 in combination. A drive mechanism 34 for the turn table 31 is constituted by a chain 35 fixed on a circumferential rim of the turn table 31, a sprocket 36 meshing with the chain 35, and a geared motor 37 for driving the sprocket 36. The turn table 31 on which the chain 35 is fixed is rotated by the rotation of the sprocket 36. The rotating hearth 2 and the heating-target mount 23 on the turn table 31 are thereby rotated. The rotating drive mechanism 34 and a drive mechanism for transporting the heating-target do not exist in the furnace. Also, a mechanism for putting in and taking out the heating-target does not exist in the furnace. Therefore, these mechanisms are not exposed to a high temperature and have improved drive stability. Also, it is not necessary to use high-temperature component parts for the mechanisms. Therefore, the equipment cost is reduced. The angle of rotation of the hearth is determined by the number of heating-targets existing in the furnace. The peripheral wall 3 surrounding the rotating hearth 2 is installed and fixed on the supporting structure member 38 of the furnace.

A charging opening 20 and an extraction opening 21 for enabling putting in and taking out of the heating-target are provided adjacent to each other in the peripheral wall 3 of the furnace body 1 in correspondence with a heating-target mount shelf 24 in each stage so as to be independently openable and closable. The charging opening 20 and the extraction opening 21 are respectively provided with doors 26 and 27 which is independently openable and closable. A spacing in which one heating-target accommodation space 22 of the heating-target mount 23 exists is set between the charging opening 20 and the extraction opening 21 to prevent adjacency between the heating-target the temperature of which has been increased as desired and that will be immediately extracted and the low-temperature heating-target that has just been charged. Thus, consideration is given to prevent a reduction in temperature of the heating-target immediately before extraction due to the influence of the low-temperature heating-target. Each of the doors 26 and 27 is turnably attached to the peripheral wall 3 of the furnace body by a hinge 39 and is opened and closed by drive with an actuator 40.

Burners 5 and 5' are used as a heat source. Each of the burners 5 and 5' is installed on the peripheral wall 3 of the furnace body so as to jet a combustion gas substantially along a line tangent to the circumference of an axial-flow fan 11 placed at a center of the furnace body. The burners 5 and 5' are placed in a heating zone 17 and a soaking zone 16, respectively, and are arranged so that the burner outputs are independently controlled by means of a controller not shown in the drawings, according to the temperatures in the zones 17 and 16 detected with temperature sensors (not shown) also provided in the zones.

The axial-flow fan 11 that blows out the in-furnace gas toward the hearth 2 is installed to the roof 4 of the furnace body. A motor 41 for the axial-flow fan 11 is mounted outside the peripheral wall 3 to drive in a chain drive manner a shaft 42 of the axial-flow fan 11 projecting outside the furnace. Reference numeral 43 in the figure denotes a chain cover.

The interior of the furnace is separated into an outer peripheral region 6 and an inner region 7 by the annular partition 8, and paths 9 and 10 in which circulating flows are reversed in the vicinity of the hearth 2 and in the vicinity of the roof 4, respectively. The heating-target mount 23 is installed in the outer peripheral region 6.

The heating-target mount 23 is provided with annular heating-target mount shelves 24 in a plurality of stages (e.g., 3 to 5 stages) with no outer peripheral walls, on which heating-targets are placed so as to be loadable and extractable in a radial direction. The heating-target mount 23 is installed along the peripheral wall 3 on the rotating hearth 2 in the outer peripheral region 6. The heating-target mount shelves 24 are constructed by radially arranging metallic rods 44 in the form of a drain board with constant pitches. A circulating flow can pass through each heating-target mount shelve 24 along a vertical direction.

The heating-target mount 23 is provided with partitions 25 which extend through the heating-target mount shelves 24 in a vertical direction, and independent heating-target accommodation spaces 22 separated by vertical partitions are formed on each shelf so that hot air flowing in each heating-target accommodation space 22 does not flow into any other heating-target accommodation space 22. Since a small leak of hot air is not a problem with the partitions 25, thin iron plates are freely expandably supported by being inserted in grooves in steel channels (not shown) vertically disposed.

Partitions 12 partitioning the space in the inner region 7 into a space communicating with the heating zone 17 in the outer peripheral region 6 and a space communicating with the soaking zone 16 are disposed inside the annular partition 8. The partitions 12 are provided to bisect hot gas blown out from the axial-flow fan 11 into the inner region 7 while setting the inlet opening angle $\theta_1$ on the side of the space communicating with the heating zone 17 to 180° and reducing the outlet opening angle $\theta_2$ in the vicinity of the hearth 4 to 120° to increase the flow velocity of the circulating gas according to the amount of reduction in the outlet opening area, thereby enabling the hot gas to be supplied to the heating zone 17 at a velocity higher than the velocity at which the hot gas is supplied to the soaking zone 16. In this way, hot gas circulation through the heating zone 17 where throwing in of a large amount of heat and high-velocity hot gas circulation are required for rapidly increasing the temperature, and hot gas circulation through the soaking zone 16 saturated in terms of amount of heat are performed by one circulating fan 11.

In the furnace of this embodiment, each of the doors 26 and 27 is opened and closed through control of the actuator 40 and the heating-target can be put in or taken out by being moved straight to or moved straight back from the charging opening 20 or the extraction opening 21. Therefore, charging of the heating-target in the furnace and extraction of the heating-target can be performed by a robot and a piece of auxiliary equipment such as a charging and extracting conveyor can be removed.

In the thus-constructed aluminum T6 heat treatment furnace, hot air supplied from the burners 5 and 5' is blown out from the axial-flow fan 11 into the inner region 7 formed as a space inside the annular partition 8, moves downward in the annular partition 8 along the annular partition 8, passes through the path 9 in the vicinity of the rotating hearth 2 flows out of the outer peripheral region 6 outside the annular partition 8, and heats the heating-target while passing through the heating-target mount shelves 24 of the heating-target mount 23 and moving upward. The hot air is again heated by the heat sources 5 and 5' or is mixed with hot air supplied from the heat sources 5 and 5' so that the temperature of the hot air is increased to the set point. The hot air is thereafter drawn into the axial-flow fan 11, thus forming circulating flows circulating between the outer peripheral region 6 and the inner region 7 through the entire interior of the furnace. At this time, since certain circulations of the atmospheric gas in the furnace are effected, the output of a particular one of the burners can be supplied to a particular one of the zones, that is, the output of the heating zone burner 5 can be supplied to the heating zone 17 and the output of the soaking zone burner 5' to the soaking zone 16. Then, the output of the heating zone burner 5 and the output of the soaking zone burner 5' are independently controlled according to the temperatures of the zones to separately supply the necessary amount of heat for the heating zone 17 where the temperature drop caused by the heating-target newly thrown in is large and the necessary amount of heat for the soaking zone 16 where the temperature drop is small, while equalizing the temperature of the hot gas supplied to the heating zone 17 and the temperature of the hot gas supplied to the soaking zone 16.

At this time, in the heating temperature region in which convection heat transfer in aluminum T6 heat treatment is dominant, the heating zone 17 and the soaking zone 16 can be formed by virtue of the flow velocity difference in the circulating gas even though the circulating gas at a fixed temperature is used. Thus, the heating zone and the soaking zone can be set without providing a large thermal head.

Consequently, hot air can be blown in ideal flows to the heating-target at the outer periphery of the hearth; the heating power by convection heat transfer is improved; heating time differences between heating-targets are reduced; and the total temperature rise time is reduced.

The embodiment has been described as a preferred example of implementation of the present invention. However, the present invention is not limited to the described embodiment. Various changes and modifications can be made in the described embodiment without departing the gist of the invention. For example, while the embodiment has been described with respect to an example of application to a basketless rotating-hearth-type aluminum alloy heat treatment furnace, the present invention is not limited to this; the present invention can be implemented in a case where heat treatment is performed on a heating-target put in a basket, and can be applied to heat treatment on a nonferrous alloys other than aluminum alloys, heat treatment on steel, and the like.

The invention claimed is:

1. A hot-air circulation furnace comprising:

a furnace body having a heat source and a rotating hearth;

an annular heating-target mount having a heating-target mount shelf, which is provided at a position on the rotating hearth closer to an outer periphery of the rotating hearth along a peripheral wall of the furnace body, on which a heating-target is mounted so that the heating-target can be carried in or carried out in a radial direction, and through which a circulating flow of hot gas can pass along a vertical direction;

an annular partition, which separates an interior of the furnace into an outer peripheral region in which the heating-target mount is installed and an inner region inside the outer peripheral region, and which forms upper and lower paths in which the inner peripheral region and the outer region are communicated in a vicinity of the rotating hearth of the furnace body and in a vicinity of the roof of the furnace body;

an axial-flow fan, which is provided in a vicinity of a roof of the furnace body, and which draws in the hot gas heated by the heat source in a direction from its outer periphery toward its central portion and blows out the hot gas toward the rotating hearth through the inner region formed as a space inside the annular partition; and the hot gas, blown out from the axial-flow fan in the inner region, passes through the path in the vicinity of the rotating hearth in the annular partition along the annular partition, flowed out radially in the outer peripheral region outside the annular partition, passes through the heating-target mount shelves of the heating-target mount and moves upward, again heated by the heat sources, drawn into the axial-flow fan, and forming the circulating flow.

2. The hot-air circulation furnace according to claim 1, wherein a plurality of zones are formed in the furnace body, and a heat source which is independently controllable is provided in correspondence with each zone.

3. The hot-air circulation furnace according to claim 2, wherein a flow straightening member having a surface parallel to the flowing direction of the circulating flow is provided in a portion of the path for the circulating flow.

4. The hot-air circulation furnace according to claim 3, wherein the flow straightening member is placed on one of the drawing-in side and the blowing-out side of the axial-flow fan.

5. The hot-air circulation furnace according to claim 3, wherein the flow straightening member is a partition provided in the inner region inside the annular partition.

6. The hot-air circulation furnace according to claim 1, including a further partition in the inner region so that the inner region is formed as a space inside the annular partition for supplying the hot gas blown out from the axial-flow fan to the heating-target mount while increasing a velocity of part of the hot gas by reducing an opening of the space in the inner region at an outlet side relative to the opening of the space at an inlet side of the inner region.

7. The hot-air circulation furnace according to claim 1, wherein the heating-target mount has the heating-target mount shelves in a plurality of stages.

8. The hot-air circulation furnace according to claim 7, wherein the heating-target mount is separated along a circumferential direction by partitions for defining along the circumferential direction in correspondence with spaces in each of which the heating-target is mounted to be processed at a time, and is provided to communicate together in a vertical direction through the heating-target mount shelves.

9. The hot-air circulation furnace according to claim 7, wherein the furnace further comprises a charging opening and an extraction opening in the peripheral wall of the furnace body for enabling the heating-target to be charged and extracted with respect to the heating-target mount shelf in each stage on the heating-target mount.

10. The hot-air circulation furnace according to claim 9, wherein the charging opening and the extraction opening are independently opened and closed, and a space between the charging opening and the extraction opening is set so as to have at least one accommodation space for the heating-target of the heating-target mount.

* * * * *